United States Patent [19]

Moret

[11] 4,391,386

[45] Jul. 5, 1983

[54] HANDLING CASE WITH INCORPORATED FOLDABLE LID

[75] Inventor: Michel Moret, Ermont, France

[73] Assignee: Allibert S.A., France

[21] Appl. No.: 340,926

[22] Filed: Jan. 20, 1982

[30] Foreign Application Priority Data

Jan. 21, 1981 [FR] France ..... 81 01034

[51] Int. Cl.[3] ..... B65D 43/14; B65D 51/04

[52] U.S. Cl. ..... 220/343; 220/333

[58] Field of Search ..... 226/333, 4 F, 334, 337, 226/343; 206/518, 519, 520, 508, 509

[56] References Cited

U.S. PATENT DOCUMENTS

| | | | |
|---|---|---|---|
| 1,364,277 | 1/1921 | Heyden . | |
| 3,463,345 | 8/1969 | Bockenstette | 220/343 |
| 3,760,970 | 9/1973 | Lutz | 220/4 F |
| 4,161,261 | 7/1979 | Frater | 220/343 X |
| 4,213,539 | 7/1980 | Reuter | 220/333 |

FOREIGN PATENT DOCUMENTS

| | | |
|---|---|---|
| 1089786 | of 0000 | Canada . |
| 485103 | of 0000 | Belgium . |

*Primary Examiner*—George T. Hall

*Attorney, Agent, or Firm*—Pollock, Vande Sande & Priddy

[57] ABSTRACT

Handling case with incorporated foldable lid.

According to the invention, the case includes a lid made of two parts (4, 5) hinged to one another about a hinge (6) and which may be tipped against one another, hook-shaped mechanisms (12) being provided on the front part (5) of the lid which lock into slots (13) formed in a corresponding location along the edge (14) of the case when the lid is closed.

The invention is applicable in particular to cases which can be stacked one inside the other when they are empty.

7 Claims, 8 Drawing Figures

HANDLING CASE WITH INCORPORATED FOLDABLE LID

This invention basically concerns a handling case with an incorporated hinged lid.

More specifically, a handling case according to the invention is of the type including a lid hinged to the body of the case at one of its edges along a hinge formed toward the upper edge of the case, and is characterized in that said lid is divided into two parts hinged to one another about a second hinge parallel to the first, thereby forming, respectively, a rear part hinged about said first hinge on said edge of the case, and a forward part hinged to said rear part of the lid about said second hinge, said forward part including, in the vicinity of the ends of said second hinge, hoook-shaped or similar parts which, in the tipped position of the lid, lock into slots formed in corresponding positions along the edge of the case, said forward part also including conventional means for locking the lid to the case.

According to another characteristic of the invention, said two parts of the lid include clip type locking mechanisms which work together to allow for the locking of said forward part against said rear part when the two top surfaces thereof are tipped one against the other.

This construction concept makes it possible to gain a number of advantages vis-a-vis known types of cases with incorporated lids.

The construction in two lid parts hinged to each other makes it possible, in the open position of the case with the two parts of the lid clipped against one another and tipped behind one of the long sides of the case, to leave the top opening and the front of the case completely free of obstructions, thereby facilitating the handling of the objects to be placed in the case.

This same design in two hinged parts which may be clipped to one another makes it possible to obtain extremely good locking of the lid in the closed position of the case while avoiding the bulkiness and awkwardness associated with the use of a large one-piece lid or two half-lids hinged on the upper edge of the case on each side thereof.

In addition, the design of the case as mentioned above makes it possible to design cases in such a way that they may, when empty, be stacked one inside the other to take up less space when being returned, this without having the open lids, all tipped to the same side, preventing such stacking of cases. This solution has an obvious advantage over a solution with non-movable lids as there is no danger of losing the lids when returning the cases since each case remains attached permanently to its own lid.

The invention will become more clearly understood with the help of the description below, with reference to the attached drawings which illustrate one mode of execution by way of example. In these drawings.

Figure 1:
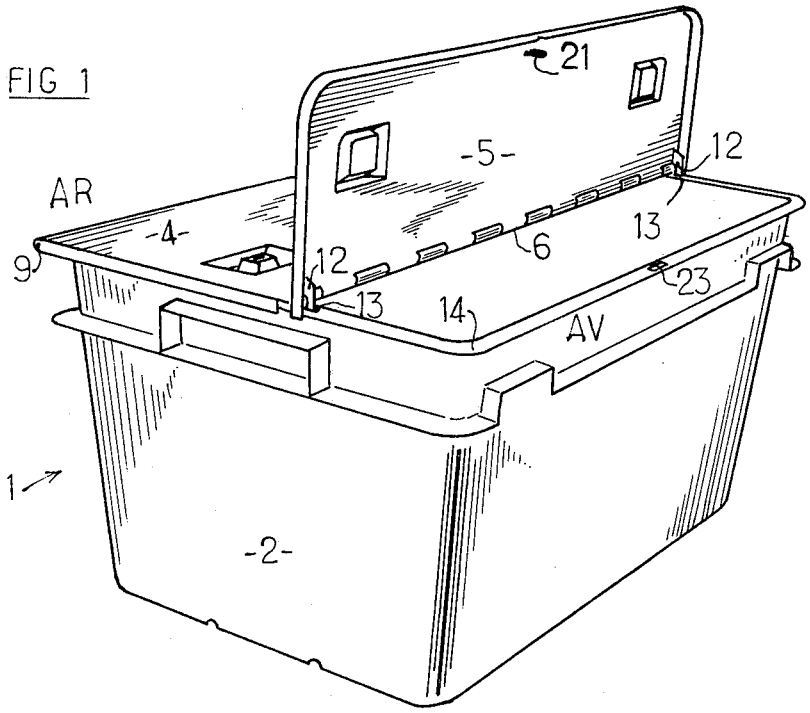
FIG. 1 shows a perspective view of a case according to the invention, with the forward part of the lid which has begun to be opened.
Figure 4:
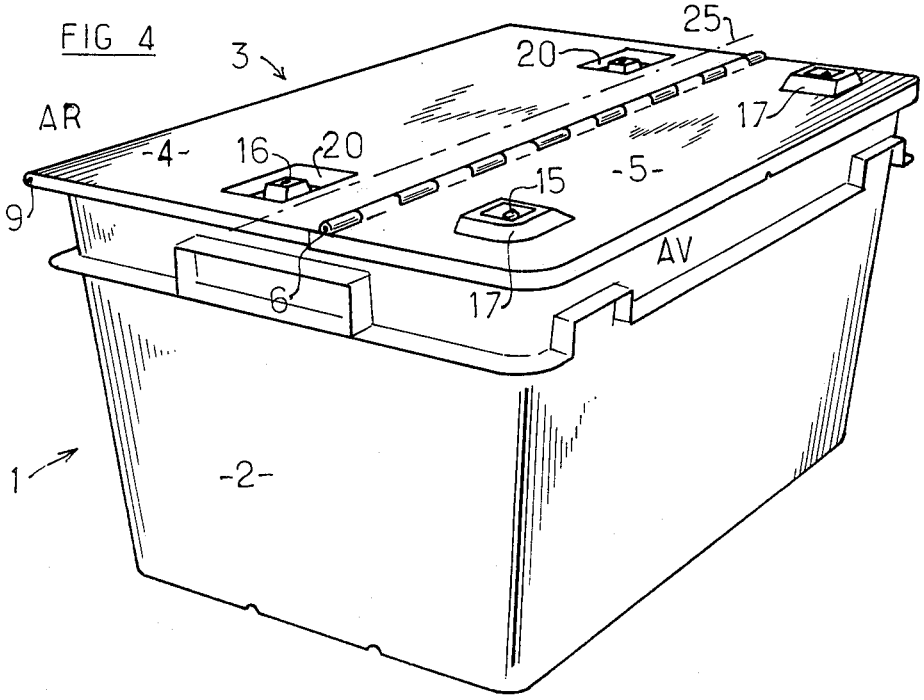
FIG. 4 shows, like FIG. 1, a perspective view of the case, here with the lid closed.

In accordance with the mode of execution illustrated in the drawings, a case 1 in accordance with the invention consists essentially in a body 2 on which is mounted a lid 3 made up of two hinged parts, a rear one 4 and a front one 5, respectively. In FIGS. 1 and 4, the letters AR and AV indicate the "rear" and "front" sides of the case, respectively, this with reference to the opening system giving free access initially to the "front" side.

The rear part 4 and front part 5 of the lid are hinged together about a hinge whose axis is indicated with reference number 6. This hinge may be of any known type, consisting, for example, of a steel axis and trunions 7, 8 molded from material in the front part 5 and rear part 4 of the lid (see FIGS. 2 and 3). The case and its lid may generally be molded from plastic to good advantage.

In addition, the rear part 4 of the lid is hinged about an axis 9 near the upper edge of the case. This hinging, like that of the two parts of the lid, for example, may be made up of trunions 10, 11 which work together and are molded in both the rear part of the lid 4 and on the upper rear edge of the case along the axis of the hinge 9. As pivot, a metallic rod (not shown) threaded through the trunions 10, 11 may be used.

In order that the lid may completely lock flat against the case in the tilted position as illustrated in FIG. 4, near the ends of hinge 6, integral with the front part 5 of the lid, are provided hook-shaped or similar parts 12 which in the tipped position of the lid are locked into slots 13 (see FIG. 1) made in corresponding positions along the top edge 14 of the body 2 of the case.

Moreover, also apparent (see FIGS. 1 to 4), formed out of the front part 5 of the lid, are the hook-shaped pins 15 which, when part 5 is in the tipped position with respect to part 4, are locked by clipping into the corresponding openings 16 in the upper surface of the rear part 4 of the cover. In the example illustrated, and to provide for better guiding of these cooperating units, these locking pins 15 are centered inside an edge 17 which protrudes from the surface of the lid with inclined sides 18 and 19, with edge 17 being received in a basin 20 with a corresponding cross section, formed in part 4 of the lid and surrounding the openings 16.

Finally, on the lower surface of the front part 5 of the lid is the locking pin 21 for the lid, which goes into the lid-locking position in the catch 23 provided in a corresponding location along the edge 14 of the body of the case. In the pin 21, which may be in the shape of a hook, there may, for example, be a padlock or lead security seal.

To good advantage, the front part of the lid may include (see FIGS. 2 and 3) small ratchet teeth 22 formed in the forward return 23 of lid part 5, which will lock the lid elastically beneath the upper edge 14 of the body of the case when the lid is firmly applied in closing the case. Such methods are conventional, and other equivalent means may be used.

Figure 2:
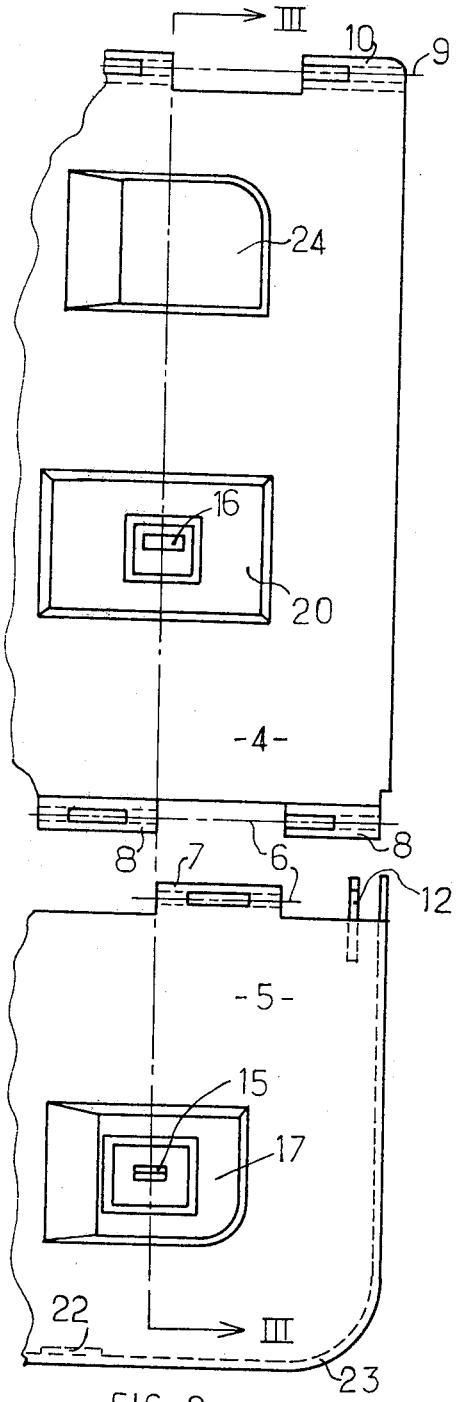
FIG. 2 is a view from above, in a larger scale, with pulling of the two lid parts, which have been separated.
Figure 3:
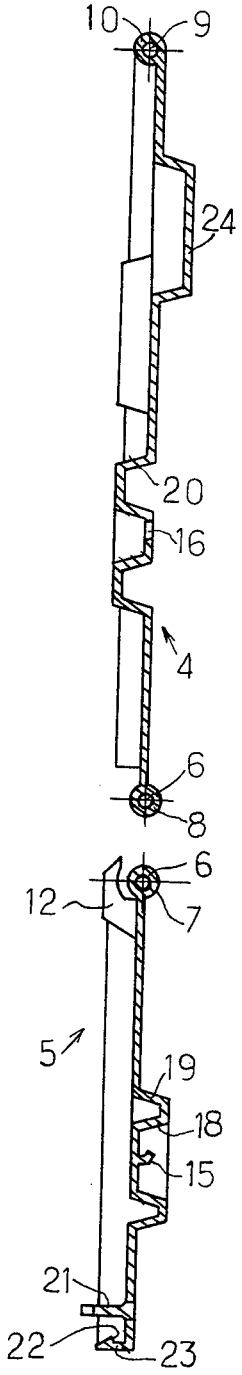
FIG. 3 is a cross section view along plane III—III in FIG. 2.
Figure 5:
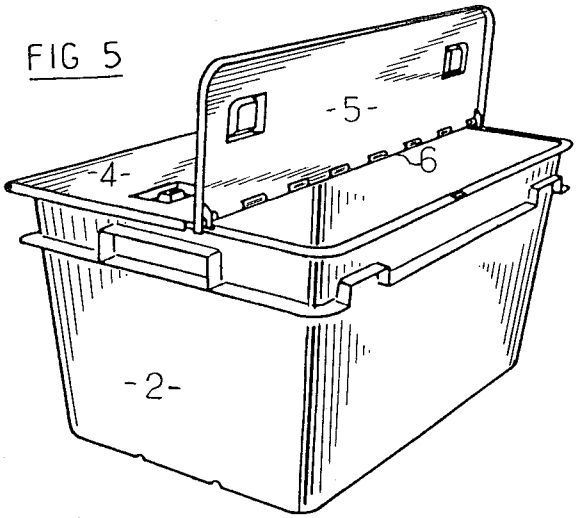
FIGS. 5 to 8 show a perspective view, on a smaller scale than in FIGS. 1 to 4, of four successive intermediary positions illustrating the opening phase and tipping of the lid behind the case.

Finally, FIGS. 2 and 3 illustrate the possibility of forming protuberances 24 (not shown on the other figures) on the lid. These protuberances, in conjunction with protruding edges 17, may facilitate the formation of stable stacks of superimposed cases, as these protuberances may, in a known manner, work together with the hollowed out corresponding parts under the bottoms of the cases.

The above description clearly shows the advantages obtained by using cases according to the invention.

Figure 6:
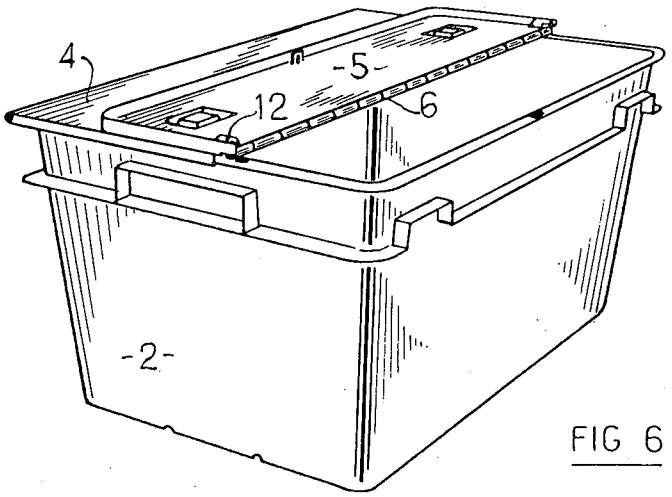
Figure 7:
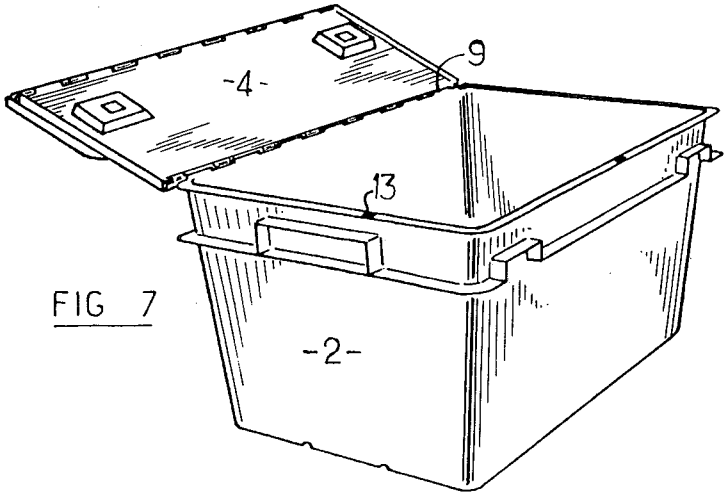
Figure 8:
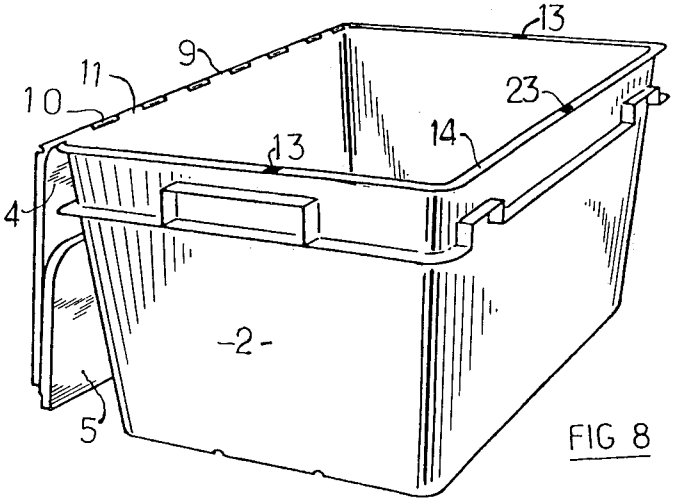

As illustrated in FIGS. 5 to 8, when one wishes to open a case, one first raises the front part 5 of the lid (FIG. 5), tips it up and locks it by clipping together the associated bodies 15, 16 against the rear part 4 of the lid (FIG. 6). Then the rear part 4 may be raised pivoting about the hinge 9, then tipping the lid behind the long side of the case (FIG. 8).

In this position, if the bodies 2 of cases are shaped in such a way that they can be stacked one inside the other, other cases may be stacked above the open case, with the lids folded in two, overlapping one another in the manner of roof tiles.

It will be noted that in the position illustrated in FIG. 8, access over the front of the case is entirely free and that no obstacle is posed by the lid folded behind the case.

Of course, the invention is in no way limited to the mode of execution illustrated and described, which has been provided by way of example only. Thus, while the description is that of a preferred embodiment in which the lid 3 is formed in two parts 4 and 5, of slightly dissimilar size, the front part 5 being smaller than the rear part 4 (the axis of hinge 6 being offset toward the front vis-a-vis the median line 25 in FIG. 4) of the lid, it would be possible to make the lid following a similar principle, for example in three articulated panels which would be of a size such that they would clip one to the next. The invention hence includes all technical equivalents of the methods described as well as their combinations, if the latter are carried out in the spirit of the invention and implemented within the framework of the following claims. In particular, the hinges 6, 9 shall advantageously be of a secure type, i.e., such that the axis of the hinge cannot be removed by exerting outside axial pressure if the case entails locking mechanisms involving padlocks or other locks.

I claim:

1. A handling case entailing a lid hinged to the body of the case along one of its edges along a hinge formed toward the upper edge of the case, characterized in that the said lid (3) is divided into two parts (4, 5) hinged one to the other about a second hinge (6) parallel to the first hinge (9), respectively forming a rear part (4) articulated around the said first hinge (9) on the said edge of the case, and a front part (5) hinged to the said rear part (4) of the lid about the said second hinge (6), the said front part (5) including, in the vicinity of the ends of the said second hinge (6), hook-shaped or similar parts (12) which in the tipped position of the lid are locked into slots (13) formed in corresponding positions along the edge (14) of the case, the said front part (5) also including conventional locking mechanisms (21, 22) to lock the lid onto the case.

2. A case according to claim 1, characterized in that the said two lid parts include clippable type locking mechanisms (15, 16) which work together to permit the locking of the said front part (5) against the said rear part (4) when the two upper surfaces of the said two parts are tilted one against the other.

3. A case according to claim 1 or claim 2, characterized in that the aforementioned rear part (4) of the lid is larger than the said front part (5), the said second hinge (6) being offset toward the front side of the case.

4. A case according to claim 2 or claim 3, characterized in that the guide mechanisms which work in harmony and are provided in relief and hollowed out on each lid part (4, 5) surround the said clipping means (15, 16).

5. A case according to any one of the preceding claims 1–4, characterized in that the said cases are largely rectangular in cross section and that the said rear part (4) of the said lid is hinged along one of the long sides of the case.

6. A case according to any one of the preceding claims 1–5, characterized in that the said cases have cross sections, known in and of themselves, which make it possible to store them in a stacked position.

7. A case according to any one of the preceding claims 1–6, characterized in that the said hinges (6, 9) are of an inviolable type.

* * * * *